US007610906B2

(12) United States Patent
Takakura et al.

(10) Patent No.: US 7,610,906 B2
(45) Date of Patent: Nov. 3, 2009

(54) FUEL VAPOR TREATMENT SYSTEM

(75) Inventors: Shinsuke Takakura, Kawasaki (JP); Masao Kano, Gamagori (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 12/155,513

(22) Filed: Jun. 5, 2008

(65) Prior Publication Data

US 2008/0314369 A1 Dec. 25, 2008

(30) Foreign Application Priority Data

Jun. 25, 2007 (JP) ..... 2007-166846

(51) Int. Cl.
*F02M 33/02* (2006.01)

(52) U.S. Cl. ..... 123/520

(58) Field of Classification Search ..... 123/516, 123/518, 519, 520, 198 D
See application file for complete search history.

(56) References Cited

U.S. PATENT DOCUMENTS

| | | | | |
|---|---|---|---|---|
| 5,862,795 | A * | 1/1999 | Osanai | 123/520 |
| 5,957,115 | A * | 9/1999 | Busato et al. | 123/520 |
| 6,105,556 | A | 8/2000 | Takaku et al. | |
| 6,105,557 | A * | 8/2000 | Schnaibel et al. | 123/520 |
| 6,305,361 | B1 | 10/2001 | Takaku et al. | |
| 6,325,052 | B1 | 12/2001 | Mashiki | |
| 6,332,456 | B2 | 12/2001 | Mashiki | |
| 6,397,829 | B1 | 6/2002 | Toyoda | |
| 7,347,194 | B2 * | 3/2008 | Sato | 123/520 |
| 7,506,639 | B2 * | 3/2009 | Saito | 123/520 |
| 2001/0011540 | A1 | 8/2001 | Mashiki | |
| 2005/0257607 | A1 * | 11/2005 | Suzuki | 73/118.1 |
| 2006/0225713 | A1 | 10/2006 | Kano et al. | |

FOREIGN PATENT DOCUMENTS

| | | |
|---|---|---|
| JP | 5-018326 | 1/1993 |
| JP | 6-101534 | 4/1994 |
| JP | 2006-009743 | 1/2006 |
| JP | 2007-211655 | 8/2007 |

OTHER PUBLICATIONS

Japanese Office Action dated May 25, 2009, issued in counterpart Japanese Application No. 2007-166846, with English translation.

* cited by examiner

*Primary Examiner*—Thomas N Moulis
(74) *Attorney, Agent, or Firm*—Nixon & Vanderhye P.C.

(57) ABSTRACT

A fuel vapor treatment system which has adsorbent, a purge passage for introducing a mixture gas of air and the fuel vapor desorbed from the adsorbent into the internal combustion engine, a detection passage which communicates to the purge passage, and a pump which generates gas flow so that the mixture gas flows into the detection passage from the purge passage. A pressure sensor detects fuel vapor concentration. An ECU and a purge control valve controls a purge of the mixture gas from the purge passage to the internal combustion engine based on a reference concentration of the fuel vapor. The ECU establishes the detection interval of the fuel vapor concentration in consideration of change in reference concentration.

11 Claims, 10 Drawing Sheets

| | | SWITCHING VALVE 23 | ON-OFF VALVE 22 | SWITCHING VALVE 21 | PURGE CONTROL VALVE 20 |
|---|---|---|---|---|---|
| CONCENTRATION DETECTION | (a) | I | OPEN | I | CLOSE |
| | (b) | I | CLOSE | I | CLOSE |
| | (c) | I | OPEN | II | CLOSE |
| PURGE CONTROL | (d) | I | OPEN | II | OPEN |

I :FIRST POSITION
II :SECOND POSITION

FUEL VAPOR TREATMENT SYSTEM

CROSS-REFERENCE TO RELATED APPLICATION

This application is based on Japanese Patent Application No. 2007-166846 filed on Jun. 25, 2007, the disclosure of which is incorporated herein by reference.

FIELD OF THE INVENTION

The present invention relates to a fuel vapor treatment system treating a fuel vapor which is combusted with injected fuel of an internal combustion engine.

BACKGROUND OF THE INVENTION

In the fuel vapor treatment system, fuel vapor generated in a fuel tank is temporarily adsorbed by adsorbent in a canister. Desorbed fuel vapor is mixed with air and is purged into the internal combustion engine, so that the fuel vapor is combusted with injected fuel in a combustion chamber of the internal combustion engine. In a system shown in JP-2006-312925A (US2006/0225713A1), fuel vapor concentration of the mixture gas is detected to correctly control the quantity of the purge gas.

Specifically, a purge passage is connected to a detection passage. The mixture gas of the fuel vapor desorbed from the canister and air is introduced into the detection passage, so that the fuel vapor concentration of the mixture gas is detected. Since the fuel vapor concentration is detected before purging and its detected value is reflected to the purge control from its starting time, a disturbance of the air-fuel ratio is restricted.

In a system shown in JP-2006-312925A, the detection of fuel vapor concentration is periodically performed. The detection interval of the fuel vapor concentration is set to a constant value. In a case that the detection interval is excessively long, the actual fuel concentration may deviate from the detected concentration, which may cause a disturbance of air-fuel ratio. In a case that the detection interval is excessively short, an operation frequency of a pump that generates gas flow to introduce the mixture gas into the detection passage may increase. It may cause a deterioration of the parts and its endurance.

SUMMARY OF THE INVENTION

The present invention is made in view of the above matters, and it is an object of the present invention to provide a fuel vapor treatment system which is able to restrict a disturbance of air-fuel ratio of an internal combustion engine and to ensure its endurance.

According to the present invention, a fuel vapor treatment system treats a fuel vapor which is combusted with injected fuel of an internal combustion engine. The system includes a canister containing an adsorbent which temporarily adsorbs fuel vapor generated in a fuel tank, a purge passage for introducing a mixture gas of air and the fuel vapor desorbed from the adsorbent into the internal combustion engine, and a detection passage which communicates to the purge passage. The system further includes a gas flow generating means which generates gas flow so that the mixture gas flows into the detection passage from the purge passage. The system further includes a detection means for detecting a fuel vapor condition quantity of the mixture gas flowing through the detection passage, a control means for controlling a purge of the mixture gas from the purge passage to the internal combustion engine based on a reference condition quantity which corresponds to the fuel vapor condition quantity detected by the detection means. The system further includes an interval setting means for setting a detection interval of the fuel vapor condition quantity by the detection means in consideration of a change in the reference condition quantity.

The fuel vapor condition quantity of the mixture gas flowing into the detection passage represents a condition quantity of fuel vapor which is desorbed from the adsorbent and is purged into the internal combustion engine through the purge passage. In a case that the fuel vapor is hardly desorbed from the adsorbent, a change in fuel vapor condition quantity becomes large. If the detection interval is excessively long, the air-fuel ratio may be disturbed.

According to the present invention, by considering a change in a reference condition quantity which is detected as the fuel vapor condition quantity, the detection interval is set shorter to restrict the disturbance of the air-fuel ratio. Furthermore, in a case that the fuel vapor is hardly desorbed from the adsorbent, since a change in fuel vapor condition quantity is small, the detection interval can be set longer in a range where the disturbance of the air-fuel ratio is restricted. The detection interval is made longer according to the situation. Hence an operation frequency of the gas generating means is reduced and its endurance is improved.

The fuel vapor condition quantity and the reference condition quantity are physical value representing a condition of the fuel vapor, such as fuel vapor concentration, fuel vapor flow rate, fuel vapor density and the like.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Figures 1, 4:
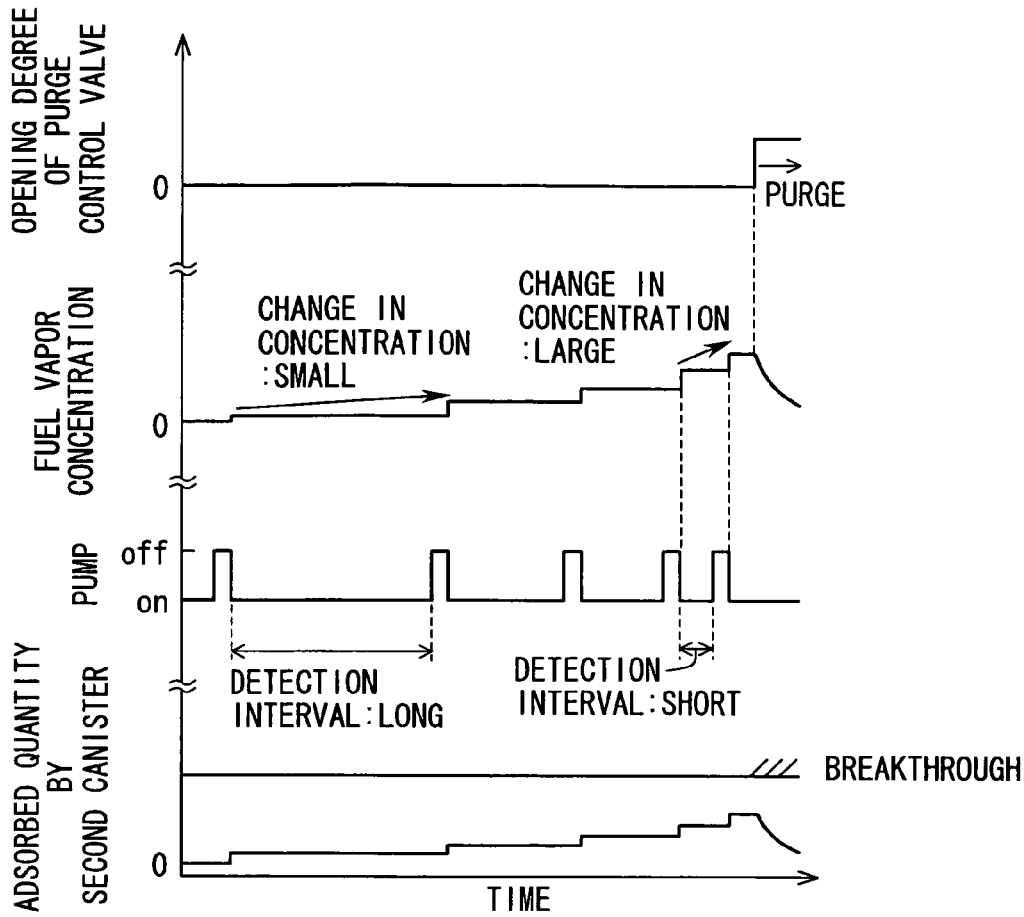
FIG. 1 is a chart for explaining a characteristic of an evaporated fuel treatment apparatus according to a first embodiment of the present invention.
FIG. 4 is a chart for explaining actuation of the control operation.

Hereafter, a plurality, of embodiments of the present invention are described. In each embodiment, the same parts and the components are indicated with the same reference numeral and the same description will not be reiterated.

First Embodiment

Figure 2:
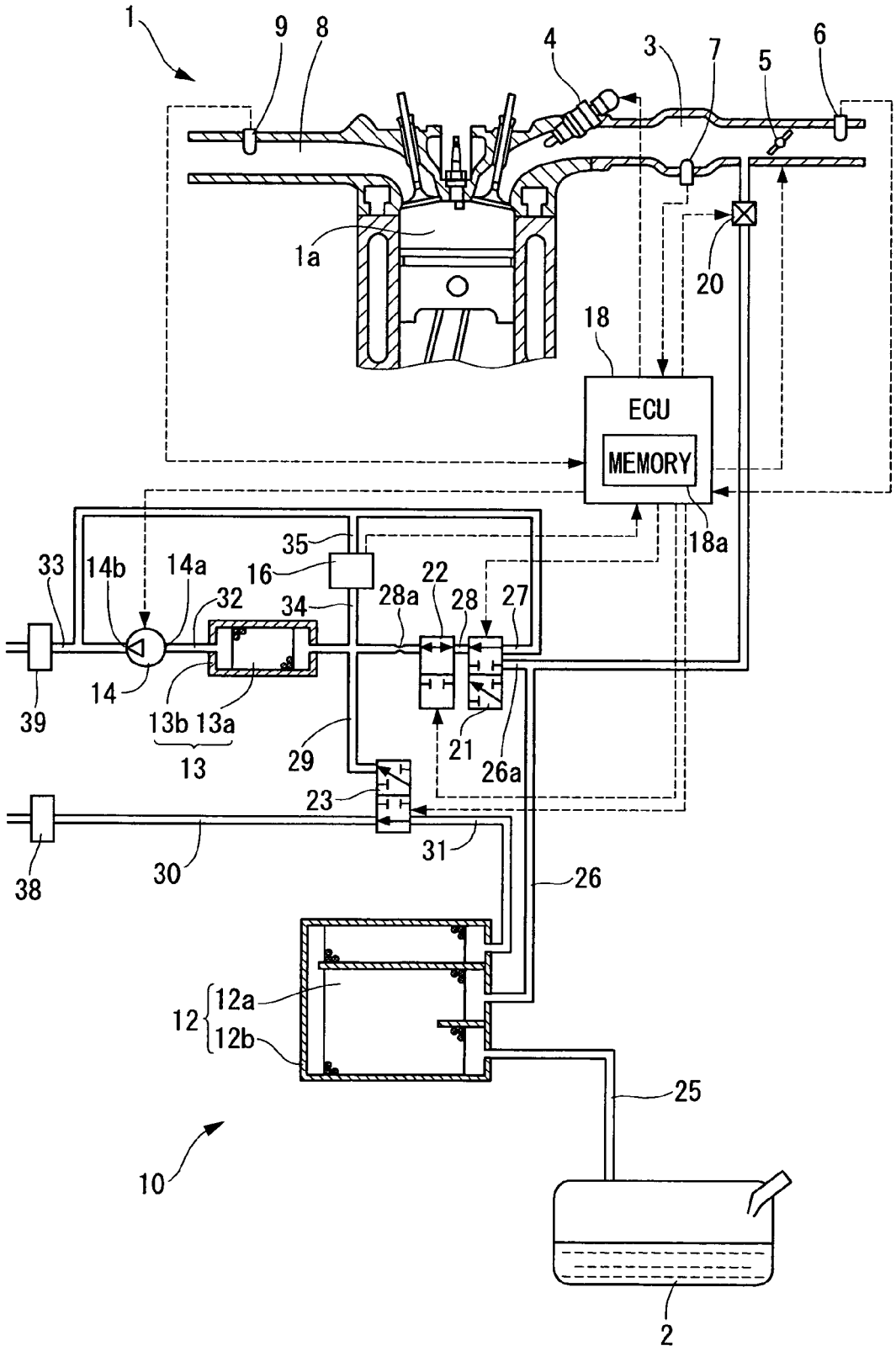
FIG. 2 is a construction diagram to show the construction of an evaporated fuel treatment apparatus according to the first embodiment of the present invention.

FIG. 2 shows a first embodiment of a fuel vapor treatment system 10 which is applied to an internal combustion engine 1.

(Internal Combustion Engine)

The internal combustion engine 1 is a gasoline engine which generates power using gasoline accommodated in an interior of a fuel tank 2. An intake pipe 3 of the engine 1 is provided with a fuel injector 4 which controls a fuel injection quantity, a throttle valve 5 which controls an intake air flow rate, an intake air flow rate sensor 6 which detects an intake air flow rate, and a intake air pressure sensor 7 which detects intake air pressure. An exhaust pipe 8 of the engine 1 is provided with an air-fuel ratio sensor 9 which detects an exhaust gas air-fuel ratio.

(Fuel Vapor Treatment System)

The fuel vapor treatment system 10 is the apparatus for treating the fuel vapor generated in the fuel tank 2, and burning the fuel vapor with the injected fuel by the fuel injector 4. The fuel vapor treatment system 10 is specifically equipped with a plurality of canisters 12 and 13, a pump 14, a pressure sensor 16, an electronic control unit (ECU) 18, a plurality of valves 20-23, a plurality of passages 25-35, and filters 38 and 39.

A canister case 12*b* of a first canister 12 is filled up with adsorbents 12*a*, such as the activated carbon, and a fuel tank 2 is mechanically connected to the canister case 12*b* through a tank passage 25. The fuel vapor generated in the fuel tank 2 flows into an interior of the canister case 12*b* through the tank passage 25 and adsorbed by the absorbents 12*a*.

The intake pipe 3 is mechanically connected to the canister case 12*b* of the first canister 12 through the purging passage 26. A purge control valve 20 adjustable in its opening is installed in the purging passage 26. The purge control valve 20 controls a communication between the intake pipe 3 and the interior of the canister case 12*b*.

When the purge control valve 20 is opened, negative pressure generated in the intake pipe 3 is introduced into the canister 12 through the purge passage 26. The fuel vapor desorbed from adsorbents 12*a* is mixed with air, and this mixture gas flows through the purge passage 26 and purged into the intake pipe 3. The mixture gas reached the fuel injection position is mixed with the fuel injected by the injector 4, and introduced into a cylinder 1*a* of the engine 1 to be combusted. In a case that the purge control valve 20 is closed, since the purge passage 26 is intercepted between the intake pipe 3 and the first canister 12, the purge of the mixture gas to the intake pipe 3 will stop.

The passage switching valve 21 is mechanically connected to a branch passage 26*a* which branches from the purge passage 26 between the purge control valve 20 and the first canister 12. The passage switching valve 21 is mechanically connected to an atmospheric air passage 27 and a first detection passage 28. The passage switching valve 21 switches the passage which communicates to the first detection passage 28 between the atmospheric air passage 27 and the branch passage 26*a*.

Therefore, when the passage switching valve 21 is in a first position where the atmospheric air passage 27 communicates to the first detection passage 28, the atmospheric air is introduced into the first detection passage 28 through a discharge passage 33, which communicates to the atmosphere through a filter 39, and the atmospheric air passage 27. When the passage switching valve 21 is in a second position where the branch passage 26*a* communicates to the first detection passage 28, the mixture gas containing the fuel vapor is introduced into the first detection passage 28 through the purge passage 26.

A second canister 13 is filled up with adsorbents 13*a*, such as the activated carbon, in a canister case 13*b*. The total capacity of the adsorbents 13*a* of the second canister 13 is established smaller than the total capacity of the adsorbents 12*a* of the first canister 12.

The first detection passage 28 is mechanically connected to the canister case 13*b* of the second canister 13. A restriction 28*a* which restricts a passage area is provided in the first detection passage 28. A passage on-off valve 22 is disposed between the passage switching valve 21 and the restriction 28*a* in the first detection passage 28. The passage on-off valve 22 controls a communication between the second canister 13 and the purge passage 26 or the atmospheric passage 27.

When the passage switching valve 21 is in the second position, the passage on-off valve 22 is opened and the purge control valve 22 is closed, the fuel vapor flowing through the purge passage 26 and the first detection passage 28 is adsorbed by the adsorbents 13*a* of the second canister 13.

When the passage switching valve 21 is in the second position, the passage on-off valve 22 is opened and the purge control valve is opened, the negative pressure in the intake pipe 3 is introduced into the second canister 13 through the purge passage 26 and the first detection passage 28 so that the fuel vapor is desorbed from the adsorbents 13*a*. The desorbed fuel vapor flows through the first detection passage 28 and the purge passage 26 in this series and is purged into the intake pipe 3 from the purge passage 26. The purged fuel vapor is combusted in the cylinder 1*a* of the engine 1 together with fuel injected by the injector 4.

One end of a first communication passage 29 is connected to the first detection passage 28 between the second canister 13 and the restriction 28*a*. The other end of the first communication passage 29 is connected to a communication switching valve 23. The communication switching valve 23 is connected to an open passage 30, which communicates to the atmosphere through a filter 38, and a second communication passage 31. The second communication passage is connected to the first canister 12. The communication switching valve 23 switches a passage which communicates to the second communication passage 31 between the open passage 30 and the first communication passage 29.

When the communication switching valve 23 is in a first position where the open passage 30 communicates to the second communication passage 31, the interior of the canister case 12*b* of the first canister 12 is opened to the atmosphere. When the communication switching valve 23 is in a second position where the first communication passage 29 communicates to the second communication passage 31, the interiors of both canisters 12, 13 are communicated to each other.

A pump 14 includes a vane-type pump which is electrically driven. A suction port 14*a* of the pump 14 is connected to the second detection passage 32 and a discharge port 14*b* is connected to the discharge passage 33. When the pump 14 is stopped, the second detection passage 32 and the discharge passage 33 are communicated to each other through an interior of the pump 14. When the pump 14 is operated, the pressure in the canister case 13*b* of the second canister 13 is reduced through the second detection passage 32, whereby a gas flow is generated in the first detection passage 28. The gas suctioned from the suction port 14*a* is discharged into the discharge passage 33 through the discharge port 14*b*. The discharge passage is opened to the atmosphere through the filter 39. The discharge port 14*b* is always opened to the atmosphere. While the pump 14 is operated, the suctioned gas is discharged into the atmosphere.

A pressure sensor 16 is mechanically connected to pressure introducing passages 34, 35. The first pressure introducing passage 34 is connected to the first detection passage 28 between the second canister 13 and the restriction 28*a*. The second pressure introducing passage 35 is connected to the atmospheric air passage 27. The pressure sensor 16 detects differential pressure between pressure in the first detection passage 28 and the atmospheric pressure.

In a case that the passage on-off valve 22 is opened and the pump 14 is driven, the pressure that the pressure sensor 16 detects substantially corresponds to a differential pressure between both ends of the restriction 28*a*. This differential pressure is referred to as a restriction differential pressure. In a case that the passage on-off valve 22 is closed and the pump 14 is driven, the pressure that the pressure sensor 16 detects substantially corresponds to shutoff pressure of the pump 14 of which inlet port 14*a* is shut. As described above, the pressure sensor 16 can detects pressure which is determined based on the restriction 28*a* and the pump 14.

The ECU 18 is comprised of a microcomputer having a memory 18*a*, and is electrically connected to the pump 14, the pressure sensor 16, the valves 20-23, and each element 4-7, 9 of the engine 1. The ECU 18 controls the operation of the pump 14 and the valves 20-23 based on detected values by the sensors 16, 6, 7, 9, coolant temperature of the engine 1, oil temperature of the vehicle, engine speed, an accelerator position, an on-off condition of an ignition switch, and the like. Further, the ECU 18 controls a fuel injection quantity, an opening degree of a throttle valve 5, ignition timing, and the like.

(Control Operation)

Figure 3:
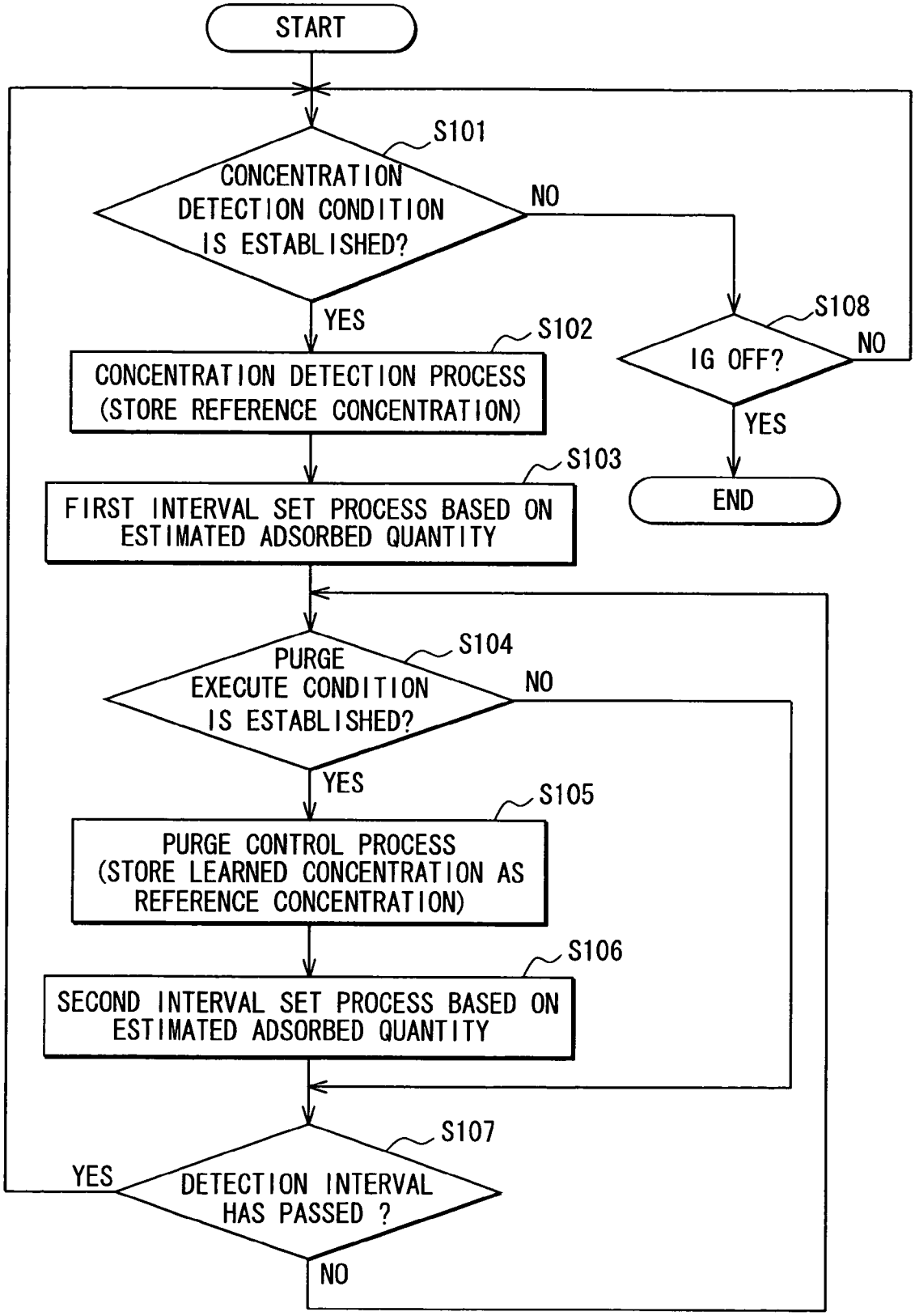
FIG. 3 is a flowchart showing a control operation according to the first embodiment.

Referring to FIG. 3, a control operation that the ECU 18 executes will be described hereinafter. The execution of the control operation is started when the ignition switch is turned on to start the engine.

In S101, it is determined whether a concentration detection condition is established. When a physical value representing an engine driving condition, such as coolant temperature, engine speed, and oil temperature are within a specified range, the concentration detection condition is established. This physical value representing the engine driving condition is referred to as a vehicle condition physical value. Such a concentration detection condition is established right after the engine 1 is started, and is stored in the memory 18*a* beforehand.

When the answer is Yes in S101, the procedure proceeds to S102. In S102, the mixture gas is introduced into the first detection passage 28 from the purge passage 26 and a concentration detection process is executed in order to detect fuel vapor concentration D in the mixture gas. Specifically, each valve 20-23 is positioned as shown by (a) in FIG. 4 and the pump 14 is operated. The air is introduced into the first detection passage 28. The pressure sensor 16 detects differential pressure between both ends of the restriction as a first pressure $\Delta P_{Air}$. Keeping the pump 14 operated, each valve 20-23 is positioned as shown by (b) in FIG. 4 in order to detect the shutoff pressure Pt of the pump 14. Successively, keeping the pump 14 operated, each valve 20-23 is positioned as shown by (c) in FIG. 4. The mixture gas in the purge passage 26 is introduced into the first detection passage 28. The pressure sensor 16 detects differential pressure as a second pressure $\Delta P_{Gas}$. During the detection of the second pressure $\Delta P_{Gas}$, the fuel vapor contained in the mixture gas is adsorbed by the adsorbent 13*a* of the second canister 13. No fuel vapor is discharged into the atmosphere.

After detecting the pressure $\Delta P_{Air}$, $P_t$, $\Delta P_{Gas}$, the fuel vapor concentration D is computed based on following equations (1)-(4). This computed fuel vapor concentration D is stored in a memory 18*a* as a reference concentration Db. A reference concentration Db which is previously stored in the memory 18*a* is updated by the currently computed concentration D. In the following equation (4), $\rho_{Air}$ represents air density, and PHC represents density of hydrocarbon in the fuel.

$$D = 100 \cdot \left[1 - P1 \cdot \{P2 \cdot (1 - \rho \cdot D)\}^{\frac{1}{2}}\right] \tag{1}$$

$$P1 = \frac{(\Delta P_{Gas} - P_t)}{(\Delta P_{Air} - P_t)} \tag{2}$$

$$P2 = \frac{\Delta P_{Air}}{\Delta P_{Gas}} \tag{3}$$

$$\rho = \frac{(\rho_{Air} - \rho_{HC})}{(100 \cdot \rho_{Air})} \tag{4}$$

When the pump 14 is stopped to terminate the concentration detection process in S102, the procedure proceeds to S103. In S103, a first interval set process is executed to set a detection interval ΔT. Specifically, in the first interval set process, an adsorbed quantity "A" of the fuel vapor in the adsorbent 12*a* of the first canister 12 is estimated based on the latest reference concentration Db stored in the memory 18*a*. The detection interval ΔT is set based on the estimated adsorbed quantity "A".

Figure 5:
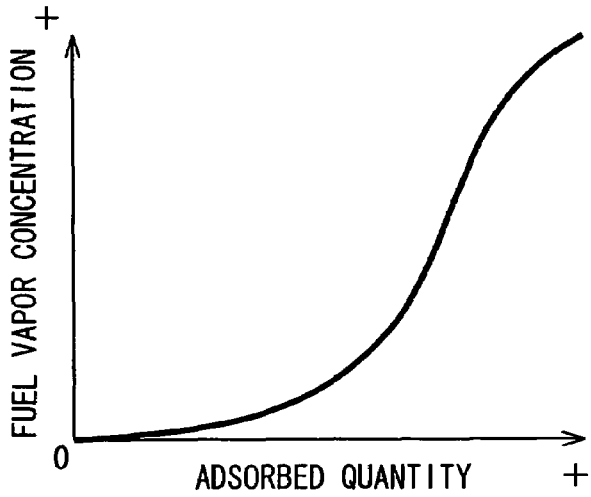
FIG. 5 is a graph for explaining a setting method of the detection interval according to the first embodiment.
Figure 6:
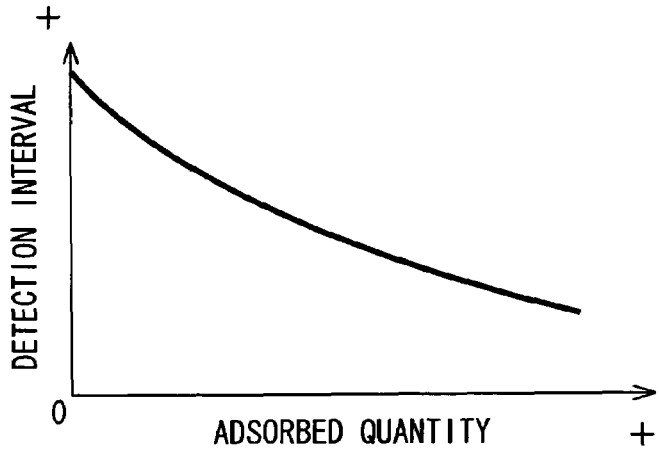
FIG. 6 is a graph for explaining the setting method of the detection interval according to the first embodiment.

As shown in FIG. 5, as the adsorbed quantity "A" decreases, the fuel vapor concentration D in the purge passage 26 hardly changes. As the adsorbed quantity "A" decreases, the fuel vapor is hardly desorbed from the adsorbent 12*a* into the purge passage 26. As shown in FIG. 6, as the adsorbed quantity "A" decreases, the detection interval ΔT becomes longer in the present embodiment. The correlation between the adsorbed quantity "A" and the detection interval ΔT shown in FIG. 6 is stored in the memory 18*a* as a table, a map, or a function expression.

In the first interval set process, the detection interval ΔT is stored in the memory 18*a*. That is, the detection interval ΔT is updated by the currently detected interval.

After the first interval set process in S103, the procedure proceeds to S104 in which it is determined whether a purge execute condition is established. When the coolant temperature, the engine speed, the oil temperature, and physical values representing a vehicle condition are out of the specified range of the concentration detection condition, the purge execute condition is established. The purge execute condition is stored in the memory 18*a* in such a manner as to be established when the coolant temperature exceeds a predetermined value so that an engine warm-up is finished.

When the answer is Yes in S104, the procedure proceeds to S105. In S105, a purge control process is executed such that the purge of the mixture gas from the purge passage 26 to the intake pipe 3 is controlled. Specifically, keeping the pump 14 stopped, each valve 20-23 is positioned as shown by (d) in FIG. 4, whereby the fuel vapor is desorbed from the adsorbents 12*a*, 13*a* of the canisters 12, 13 to be purged into the intake pipe 3.

In the purge control process, an opening degree of the purge control valve 20 is set based on the latest reference concentration Db stored in the memory 18*a* at a specified time interval. Thereby, a flow rate of mixture gas which is purged into the intake pipe 3 is adjusted according to the reference concentration Db so that a disturbance of an air-fuel ratio is well restricted.

During the purge control process, the fuel vapor concentration D is feedbacked and learned according to an engine driving condition physical value. This learned concentration D is stored in the memory 18*a* as the reference concentration Db. The reference concentration Db previously stored in the memory 18*a* is updated by currently learned fuel vapor concentration D. Therefore, even if the fuel vapor concentration D deviates from the reference concentration Db, the opening degree of the purge control valve 20 is adjusted based on the deviated fuel vapor concentration D as the reference concentration Db.

The engine driving condition physical value represents fuel injection quantity by the fuel injector 4, intake air flow rate detected by the intake air flow rate sensor 6, intake air pressure detected by the intake air pressure sensor 7, air-fuel ratio detected by the air-fuel ratio sensor 9, opening degree of the purge control valve 20 and the like. The fuel vapor quantity desorbed from the second canister 13 is estimated in order that the actual fuel vapor concentration D is obtained by the feedback adaptation.

In the purge control process, it is determined whether a purge stop condition is established at a specified time interval. When the purge stop condition is established, the purge control process is terminated. When the vehicle condition physical value such as engine speed and an accelerator position is out of the range of the concentration detection condition and the purge execute condition. The purge stop condition is stored in the memory 18*a* in such a manner as to be established when the opening degree of the throttle valve 5 is less than a specified value so that the vehicle decelerated.

After the purge control process is finished in S105, the procedure proceeds to S106. In S106, a second interval set process is executed to set a detection interval ΔT. Specifically, in the second interval set process, an adsorbed quantity "A" of the fuel vapor in the adsorbent 12*a* of the first canister 12 is estimated based on the latest reference concentration Db stored in the memory 18*a*, which is the fuel vapor concentration D adapted in the last purge control process. The detection interval ΔT is set based on the estimated adsorbed quantity "A". In the second interval set process, the detection interval ΔT is set according to the correlation shown in FIG. 6 as well as the first interval set process.

The detection interval ΔT which is set in the second interval set process is stored in the memory 18*a*. The detection interval ΔT previously stored in the memory 18*a* is updated by the currently set detection interval ΔT.

After the second interval set process is finished in S106, or when the answer is No in S104, the procedure proceeds to S107. In S107, it is determined whether the detection interval ΔT stored in the memory 18*a* has passed from when the latest process is finished between the latest concentration detection process and the latest purge control process.

When the answer is No in S107, the procedure goes back to S104. When the answer is Yes in step 107, the procedure goes back to S101. Therefore, after the detection interval ΔT has passed from the concentration detection process or the purge control process, the concentration detection condition is established so that the concentration detection process is re-executed.

When the answer is No in S101, the procedure proceeds to step 108 in which an ignition switch is turned off.

When the answer is No is 108, the procedure goes back to S101. When the answer is Yes in step 108, this control operation is terminated.

According to the above first embodiment, as shown in FIG. 1, when a change in the fuel vapor concentration D is large in the purge passage 26, the detection interval ΔT is set short. Therefore, at a start of the purge control process based on the reference concentration Db, the deviation of the actual fuel vapor concentration D from the reference concentration Db can be reduced so as to restrict the disturbance of the air-fuel ratio.

Besides, when the change in the fuel vapor concentration D is small in the purge passage 26, the detection interval ΔT is set long. As described above, the detection interval ΔT is set long in accordance with the change in the fuel vapor concentration D, whereby an operation frequency of the pump 14 is reduced so that an endurance of the pump 14 is ensured while disturbance of the air-fuel ratio is restricted. With respect to the second canister 13, since the detection interval ΔT in the concentration detection process becomes longer, a breakthrough of the adsorbents 13*a* is prevented. Therefore, the fuel vapor hardly flows back to the first detection passage 28 from the second canister and the fuel vapor suctioned by the pump 14 is hardly discharged into the atmosphere.

Second Embodiment

Figure 7:
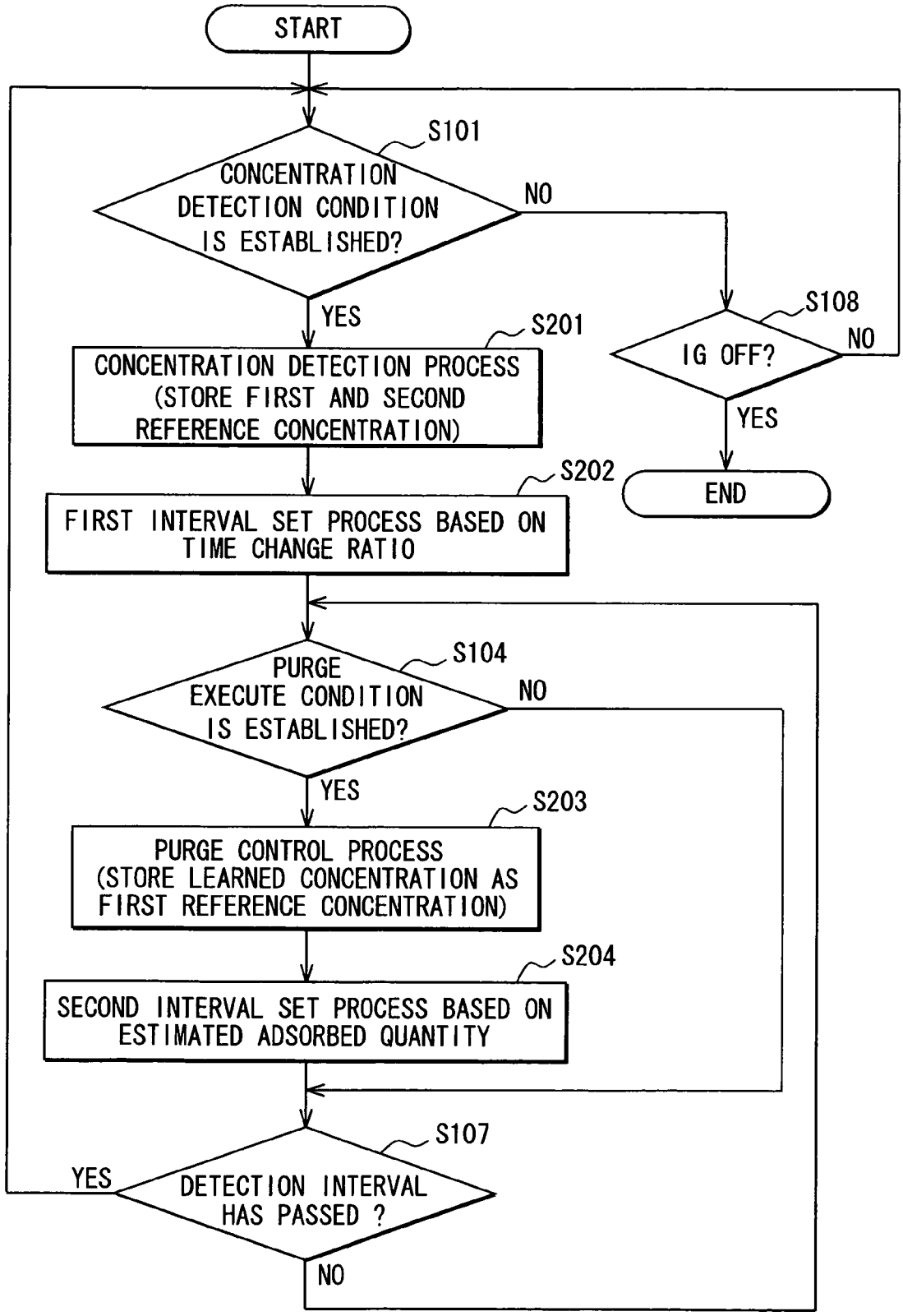
FIG. 7 is a flowchart showing a control operation according to a second embodiment.

FIG. 7 is a flowchart showing a second embodiment which is a modification of the first embodiment.

S102, S103, S105, and S106 in the first embodiment are respectively replaced by S201, S202, S203, and S204.

In S201, the pressure $\Delta P_{Air}$, $P_t$, $\Delta P_{Gas}$ are detected and the fuel vapor concentration D is computed. This concentration D is stored in the memory 18*a* as a first reference concentration Db. At this moment, the first reference concentration Db previously stored in the memory 18*a* is remained in the memory 18*a* as a second reference concentration Db. The second reference concentration Db stored in the memory is the latest value of the detected value of the fuel vapor concentration D in the previous concentration detection process and the adapted value of the fuel vapor concentration D is the latest purge control process. At the first concentration detection process, since the second reference concentration Db does no exist in the memory 18*a*, the first reference concentration Db only is stored in the memory 18*a*.

In step 202, a first interval set process is executed in which a time change ratio ΔD/ΔT of fuel vapor concentration D is computed based on an absolute differential value ΔD between the first reference concentration Db and the second reference concentration Db, and the detection interval ΔT. At the first time of the first interval set process, an estimated maximum time change ratio ΔD/ΔT is used as the currently computed value.

Figure 8:
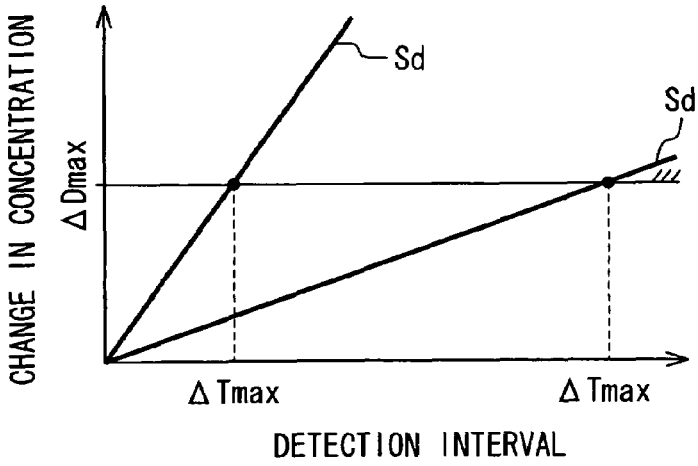
FIG. 8 is a graph for explaining the setting method of the detection interval according to the second embodiment.

In the first interval set process, when it is assumed that the fuel vapor concentration D varies at the time change ratio ΔD/ΔT, the maximum time $\Delta T_{max}$ in which the disturbance of air-fuel ratio is restricted without the concentration detection process is set as the detection interval ΔT. As shown in FIG. 8, the maximum time $\Delta T_{max}$ corresponds to the maximum permissible change quantity $\Delta D_{max}$ on characteristics lines Sd which are linear function of the fuel vapor concentration D with a gradient ΔD/ΔT. As the time change ratio ΔD/ΔT decreases, that is, as the gradient ΔD/ΔT of characteristics Sd becomes smaller, the detection interval ΔT is set longer. The characteristics line Sd is stored in the memory 18*a* in a manner of function in which the maximum permissible change quantity $\Delta D_{max}$ is substituted.

In the first interval set process, the interval ΔT is stored in the memory 18*a* in the same manner as the first embodiment.

A purge control process is executed in S203, in which the opening degree of the purge control valve 20 is determined based on the first reference concentration Db stored in the memory 18*a* and the first reference concentration Db is updated by the feedback learning value of the fuel vapor concentration D. As well as the first embodiment, the purge control process is terminated based on whether the purge stop condition is established.

In S204, a second interval set process is executed as same as the first embodiment other than the adsorbed quantity "A" is estimated from the first reference concentration Db stored in the memory 18*a*.

In the second embodiment, it is accurately determined whether the detection interval ΔT can be set longer based on the first reference concentration Db which is current fuel vapor concentration D and the second reference concentration Db which is past fuel vapor concentration D. Hence, the restriction of air-fuel ratio disturbance and the assurance of endurance are appropriately balanced.

Third Embodiment

Figure 9:
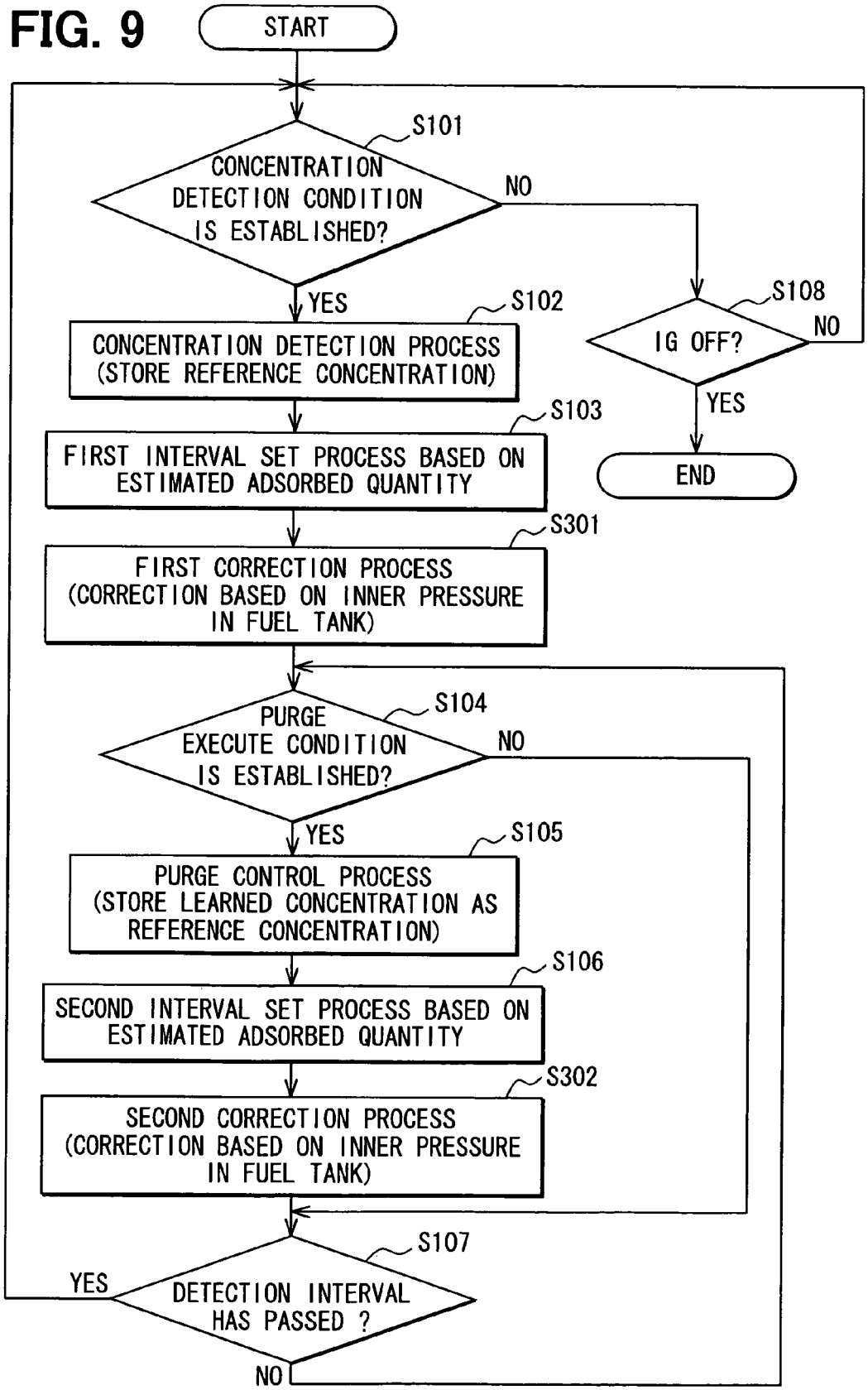
FIG. 9 is a flowchart showing a control operation according to a third embodiment.

As shown in FIG. 9, the third embodiment is a modification of the first embodiment.

In the third embodiment, S301 and S302 are respectively added after S103 and S106 of the first embodiment, so that the detection interval ΔT is corrected.

In S301, a first correction process is executed so that the detection interval ΔT is corrected based on an inner pressure P of the fuel tank 2. This is because that when the inner pressure P in the fuel tank increases, the fuel vapor quantity in the fuel tank is increased. The adsorbed quantity "A" in the first canister 12 increases and the fuel vapor concentration D in the purge passage 26 tends to be easily changed.

Figure 10:
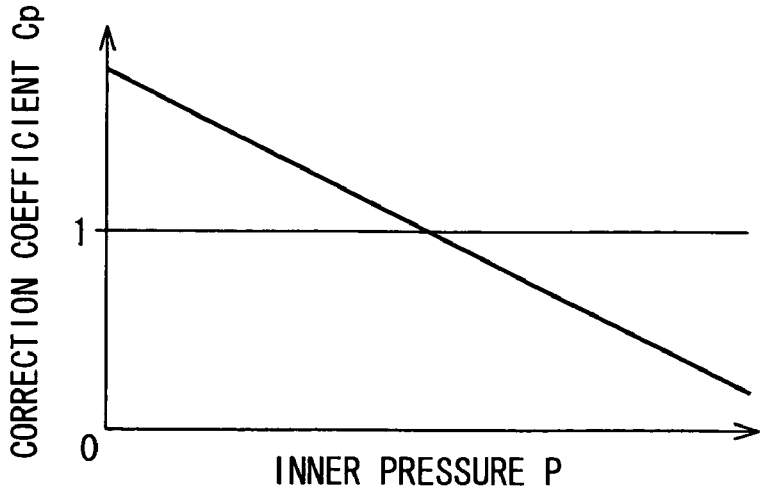
FIG. 10 is a graph for explaining a correction method of the detection interval according to the third embodiment.

In the first correction process, a correction coefficient Cp is computed according to the current inner pressure P. As shown in FIG. 10, as the inner pressure P increases, the correction coefficient Cp becomes smaller. The stored interval ΔT is multiplied by the correction coefficient Cp to correctly update the detection interval ΔT. The relationship between the inner pressure P and the correction coefficient Cp is stored in the memory 18*a* beforehand in a manner of a table, a map or a function formula. The inner pressure P of the fuel tank 2 is detected by an inner pressure sensor (not shown) provided in the fuel tank 2.

In S302, a second correction process is executed so that the detection interval ΔT which is set in the previous second interval set process is corrected by the correction coefficient Cp.

According to the third embodiment, the detection interval ΔT is set in consideration of the change in the fuel vapor concentration D due to the change in inner pressure of the fuel tank 2, so that the disturbance of air-fuel ratio is well restricted.

Fourth Embodiment

Figure 11:
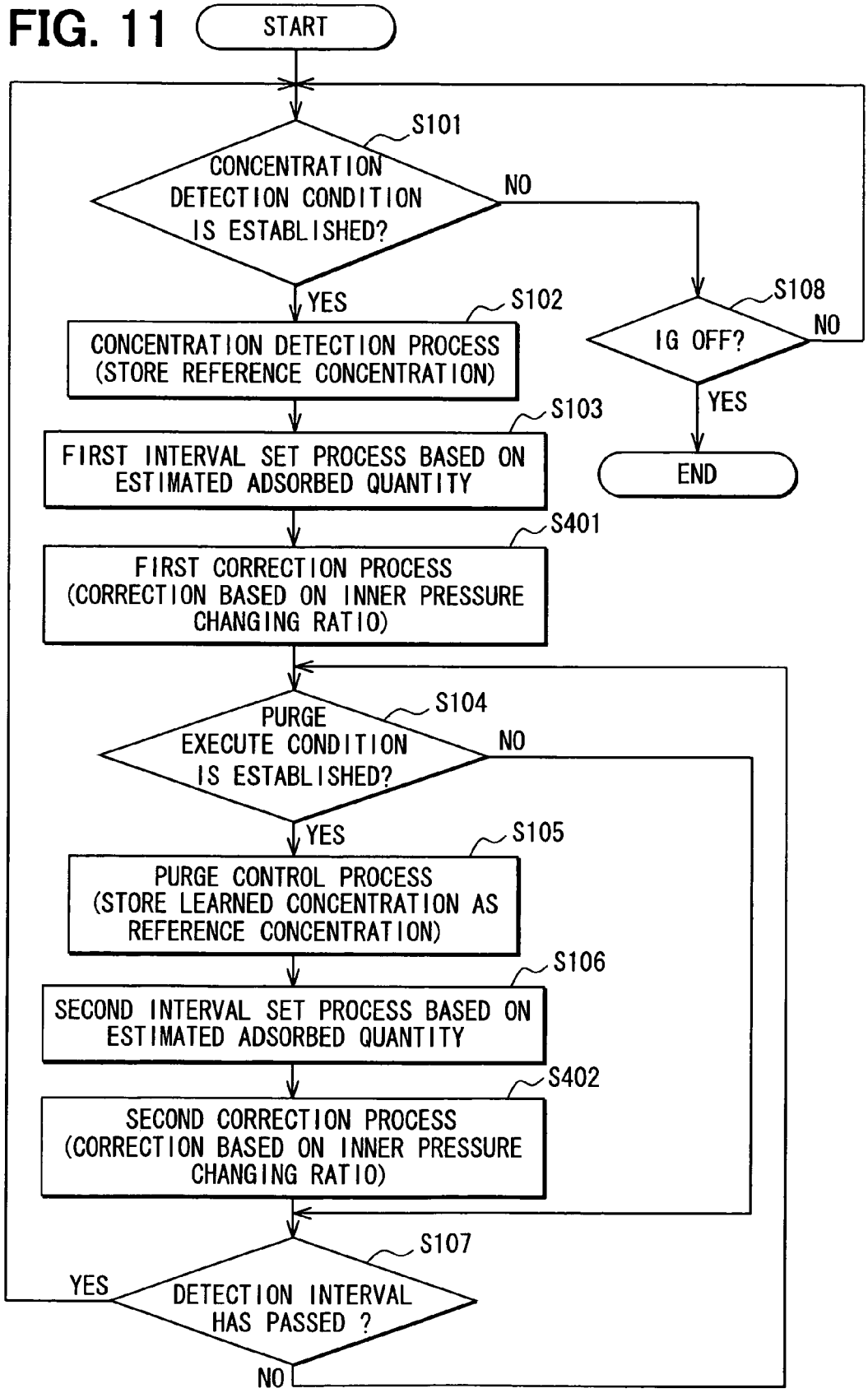
FIG. 11 is a flowchart showing a control operation according to a fourth embodiment.

As shown in FIG. 11, a fourth embodiment is a modification of the third embodiment.

In the fourth embodiment, S401 and S402 are performed in stead of S301 and S302 of the third embodiment.

In S401, a first correction process is executed so that the detection interval ΔT which is set in the previous first interval set process is corrected by a changing ratio R of the inner pressure P of the fuel tank 2. This is because that when the changing ratio R of the inner pressure P in the fuel tank 2 increases, the fuel vapor quantity in the fuel tank 2 is increased. The adsorbed quantity "A" in the first canister 12 increases and the fuel vapor concentration D in the purge passage 26 tends to be easily changed.

Figure 12:
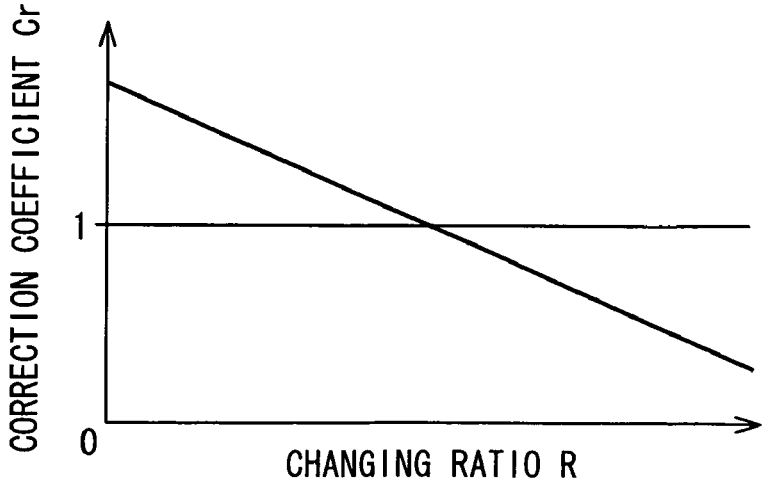
FIG. 12 is a graph for explaining a correction method of the detection interval according to the fourth embodiment.

In the first correction process, a correction coefficient Cr is derived based on the changing ratio R. As shown in FIG. 12, as the changing ratio R increases, the correction coefficient Cr becomes smaller. The detection interval ΔT is multiplied by the derived correction coefficient Cr to update the detection interval ΔT. The relationship between the changing ratio R and the correction coefficient Cr is stored in the memory 18*a* beforehand in a manner of a table, a map or a function formula. The current changing ratio R of the inner pressure P can be computed based on a plurality of measure values of the inner pressure detected by the inner pressure sensor (not shown).

In S402, a second correction process is executed so that the detection interval ΔT which is set in the previous second interval set process is corrected by the correction coefficient Cr.

According to the fourth embodiment, the detection interval ΔT is set in consideration of the change in the fuel vapor concentration D due to the change in inner pressure of the fuel tank 2, so that the disturbance of air-fuel ratio is well restricted.

Fifth Embodiment

Figure 13:
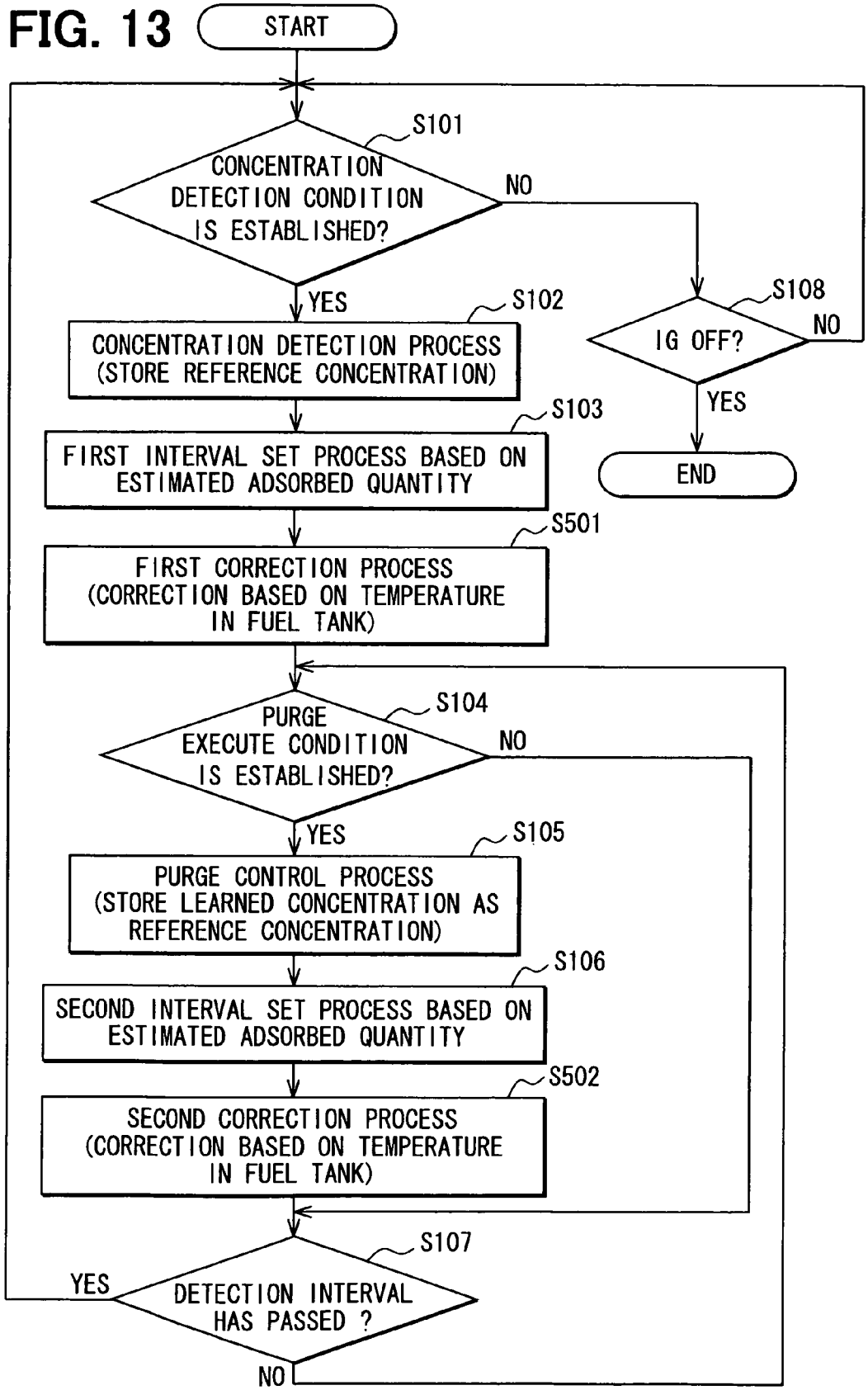
FIG. 13 is a flowchart showing a control operation according to a fifth embodiment.

As shown in FIG. 13, a fifth embodiment is a modification of the third embodiment.

In the fifth embodiment, S501 and S502 are performed in stead of S301 and S302 of the third embodiment.

In S501, a first correction process is executed so that the detection interval ΔT is corrected based on a temperature TP in the fuel tank 2. This is because that when the temperature TP in the fuel tank 2 rises, the fuel vapor quantity in the fuel tank 2 is increased. The adsorbed quantity "A" in the first canister 12 increases and the fuel vapor concentration D in the purge passage 26 tends to be easily changed.

Figure 14:
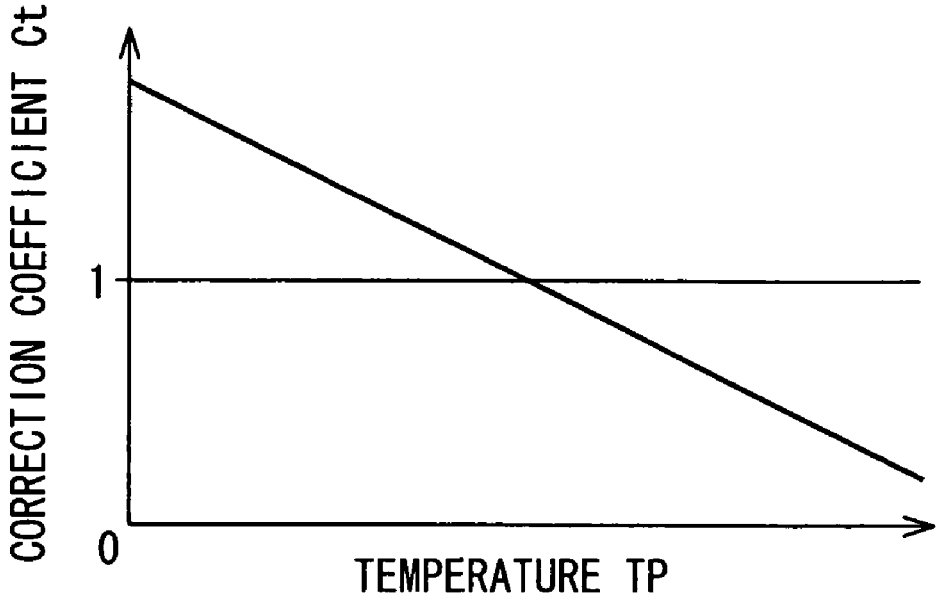
FIG. 14 is a graph for explaining the setting method of the detection interval according to the fifth second embodiment.

In the first correction process of the fifth embodiment, a correction coefficient Ct is derived in a correlation with a current temperature TP. As shown in FIG. 14, the correction coefficient Ct becomes smaller as the temperature TP rises. The derived correction coefficient Ct is then multiplied by a detection interval ΔT, which is stored in the memory 18*a*, in order to correct and update the detection interval ΔT. The correlation between current temperature TP and correction coefficient Ct is pre-stored in the memory 18*a* in a specific form such as table, map and function formula. A current temperature TP for deriving a correction coefficient Ct is determinable by using a pressure sensor (not shown) installed on the fuel tank 2 or by estimating a temperature value correlated with the current temperature TP such as outside air temperature and intake air temperature in the intake pipe 3.

In S502, a second correction process is executed so that the detection interval ΔT which is set in the previous second interval set process is corrected by the correction coefficient Ct.

According to the fifth embodiment, the detection interval ΔT is set in consideration of the change in the fuel vapor concentration D due to the change in temperature in the fuel tank 2, so that the disturbance of air-fuel ratio is well restricted.

Other Embodiment

The present invention should not be limited to the disclosure embodiment, but may be implemented in other ways without departing from the sprit of the invention.

For example, in the first to the fifth embodiment, the second canister 13 may be omitted. The detection interval ΔT can be set by the first interval set process only without executing the second interval set process. In the third to the fifth embodiment, in a case that the second interval set process is not executed, the second correction process is unnecessary.

In the second embodiment, the first correction process can be executed after the first interval set process. The second correction process can be executed after the second interval set process. Each first correction process in the third to the fifth embodiment can be combined, and each second correction process in the third to the fifth embodiment can be combined.

The fuel vapor concentration D can be detected other than using the restriction. The pump 14 can be replaced by an accumulator which accumulates negative pressure applying to the first detection passage 28.

Besides the aforementioned feedback learning control, any method that can determine a fuel vapor concentration D is usable in the purge control process set forth in the respective embodiments 1, 2, 3, 4 and 5.

Besides the aforementioned method by which the negative pressure in the intake pipe 3 is drawn simultaneously and separately on the absorbent 12*a* and absorbent 13*a* of the respective first canister 12 and second canister 13, any method is usable in the respective embodiments 1, 2, 3, 4 and 5, as long as the method can purge the adsorbent 12*a* and absorbent 13*a* of fuel vapor, and can convey the desorbed fuel vapor to the intake pipe 3.

What is claimed is:

1. A fuel vapor treatment system treating a fuel vapor which is combusted with injected fuel of an internal combustion engine, comprising:

a canister containing an adsorbent which temporarily adsorbs fuel vapor generated in a fuel tank;

a purge passage for introducing a mixture gas of air and the fuel vapor desorbed from the adsorbent into the internal combustion engine;

a detection passage which communicates to the purge passage;

a gas flow generating means which generates gas flow so that the mixture gas flows into the detection passage from the purge passage;

a detection means for detecting a fuel vapor condition quantity of the mixture gas flowing through the detection passage;

a control means for controlling a purge of the mixture gas from the purge passage to the internal combustion engine based on a reference condition quantity which corresponds to the fuel vapor condition quantity detected by the detection means; and an interval setting means for setting a detection interval of the fuel vapor condition quantity by the detection means in consideration of a change in the reference condition quantity.

2. A fuel vapor treatment system according to claim 1, wherein the interval setting means estimates a fuel vapor quantity adsorbed by the adsorbent and sets the detection interval longer according as the estimated fuel vapor quantity becomes smaller.

3. A fuel vapor treatment system according to claim 2, further comprising a learning means for learning the fuel vapor condition quantity of the mixture gas purged into the internal combustion engine based on a driving condition quantity of the internal combustion engine, wherein during a purge control, the control means updates the reference condition quantity by use of a learned condition quantity which corresponds to the fuel vapor condition quantity learned by the learning means, and the interval setting means estimates the fuel vapor quantity adsorbed by the adsorbent based on the updated reference condition quantity after purging the mixture gas into the internal combustion engine.

4. A fuel vapor treatment system according to claim 1, wherein the interval setting means computes a time changing ratio of the fuel vapor condition quantity in the mixture gas based on a plurality of the reference condition quantities which are obtained by a plurality of detection of the fuel vapor condition quantity by the detection means, and sets the detection interval longer according as the time changing ratio becomes smaller.

5. A fuel vapor treatment system according to claim 4, further comprising a learning means for learning the fuel vapor condition quantity of the mixture gas purged into the internal combustion engine based on a driving condition quantity of the internal combustion engine, wherein during a purge control, the control means updates the reference condition quantity by use of a learned condition quantity which corresponds to the fuel vapor condition quantity learned by the learning means, and after purging the mixture gas into the internal combustion engine, the interval setting means computes the time changing ratio of the fuel vapor condition quantity based on a plurality of reference condition quantities including the reference condition quantity updated by use of the learned condition quantity.

6. A fuel vapor treatment system according to claim 1, wherein the interval setting means corrects the detection interval based on an inner pressure of the fuel tank.

7. A fuel vapor treatment system according to claim 1, wherein the interval setting means corrects the detection interval based on an time changing ratio of an inner pressure of the fuel tank.

8. A fuel vapor treatment system according to claim 1, wherein the interval setting means corrects the detection interval based on a temperature in the fuel tank.

9. A fuel vapor treatment system according to claim 1, wherein a first canister serves as the aforementioned canister, a second canister has an absorbent that temporarily absorbs fuel vapor flowing into the detection passage from the purge passage, and the gas flow generating means generates gas flow in the detection passage by decompressing an interior of the second canister.

10. A fuel vapor treatment system according to claim 9, wherein the gas flow generating means includes a fluid pump which discharges suctioned gas into atmosphere.

11. A fuel vapor treatment system according to claim 1, wherein the fuel vapor condition quantity represents a fuel vapor concentration in the mixture gas.

* * * * *